US010105588B1

(12) United States Patent
Massey

(10) Patent No.: US 10,105,588 B1
(45) Date of Patent: Oct. 23, 2018

(54) SNOWBOARD BINDING WITH ADJUSTMENT MEMORY

(71) Applicant: Chasen Massey, Oakland Township, MI (US)

(72) Inventor: Chasen Massey, Oakland Township, MI (US)

( * ) Notice: Subject to any disclaimer, the term of this patent is extended or adjusted under 35 U.S.C. 154(b) by 0 days.

(21) Appl. No.: 15/715,384

(22) Filed: Sep. 26, 2017

(51) Int. Cl.
*A63C 10/06* (2012.01)
*A63C 10/24* (2012.01)

(52) U.S. Cl.
CPC ..... *A63C 10/06* (2013.01); *A63C 10/24* (2013.01)

(58) Field of Classification Search
CPC ..... A63C 10/02–10/106; A63C 10/24; A63C 10/28–10/285
See application file for complete search history.

(56) References Cited

U.S. PATENT DOCUMENTS 6,003,893 A * 12/1999 Hansen ..... A63C 10/04 280/14.21
6,007,077 A * 12/1999 Moe ..... A63C 10/045 280/14.22
9,895,597 B2 * 2/2018 Suda ..... A63C 10/06
2004/0113392 A1 * 6/2004 Elkington ..... A63C 10/04 280/617
2004/0169350 A1 * 9/2004 Elkington ..... A63C 10/04 280/623
2005/0046150 A1 * 3/2005 Couderc ..... A63C 10/04 280/623
2005/0057009 A1 * 3/2005 Couderc ..... A63C 10/04 280/11.36
2005/0161911 A1 * 7/2005 Piva ..... A63C 10/04 280/623
2005/0285372 A1 * 12/2005 Edmond ..... A63C 10/04 280/617
2006/0244241 A1 * 11/2006 Martin ..... A63C 10/04 280/619
2007/0138766 A1 * 6/2007 Couderc ..... A63C 10/22 280/618
2015/0021881 A1 * 1/2015 Hutchison ..... A63C 10/06 280/621
2017/0209772 A1 * 7/2017 Suda ..... A63C 10/24
2017/0368445 A1 * 12/2017 Mehiel ..... A63C 10/145

* cited by examiner

*Primary Examiner* — Erez Gurari
(74) *Attorney, Agent, or Firm* — Harness, Dickey & Pierce, P.L.C.

(57) ABSTRACT

A binding for snowboard includes a base structure and a heel support pivotally mounted to the base structure for movement between an open position for allowing a user to insert or remove their boot from the binding and a closed position for securing the users boot in the binding. An adjustable foot strap is attached to the base structure and a tensioning system is attached to the heel support and the adjustable foot strap for applying a tensioning force to the adjustable strap when the heel support is moved to the closed position and for releasing the tensioning force from the adjustable foot strap when the seal support is moved to the open position.

6 Claims, 12 Drawing Sheets

SNOWBOARD BINDING WITH ADJUSTMENT MEMORY

FIELD

The present disclosure relates to a binding for a snowboard and the like, and more particularly to a binding having memory features to ensure a tight, secure fit without the need of repeated adjustment, while allowing an easier boot insertion and removal without compromising security.

BACKGROUND

This section provides background information related to the present disclosure which is not necessarily prior art.

Snowboarding is a sport that has of late, been increasing in popularity. To snowboard, a rider must have boots and bindings to properly manipulate the snowboard. For the rider to be secure and allow the ability of being able to have more control, it is beneficial to have secure bindings. There are many existing bindings that are adjustable by using straps and other adjustment mechanisms to secure the boots of the rider to the board. The problem with current snowboard bindings is that they are too slow to be tightened and secured to satisfaction. This is a problem because, after each run, the rider must unstrap one boot from the binding in order to get onto the ski lift to get back to the top of the mountain. At the top of the mountain, the rider must re-strap and readjust the boots into the bindings. Another problem is that when snowboard riders desire to practice stunts on rails or other terrain, they must continually unstrap their bindings to remove their boots from the bindings and have to then re-strap their boots into their bindings. The act of re-strapping and readjusting becomes annoying and monotonous and can even cause the rider's gloves to wear down after a while.

SUMMARY

This section provides a general summary of the disclosure, and is not a comprehensive disclosure of its full scope or all of its features.

The object of the disclosure is to improve upon other bindings. This is done by greatly reducing the amount of time that it takes to strap the rider's boots into the bindings and onto the board. Along with allowing quicker strapping in, it is an object of the present disclosure to provide consistent security and stabilization with each time the boot is inserted in the bindings. This is important because a snug, stable fit relates to how the rider can properly manipulate the snowboard. A snug and stable fit is not present in all other snowboard bindings, and ease of getting into the bindings compromises this choice fit. The binding of the present disclosure works by using one pivoting toggle lever, rider pre-adjusted straps, a pivoting heel support, and a release and tightening mechanism attached to the riders pre-adjusted straps. All the rider needs to do is adjust the binding's straps once in order to subsequently achieve a secure and stable fit every time they take the boots out of the bindings and re-insert them.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
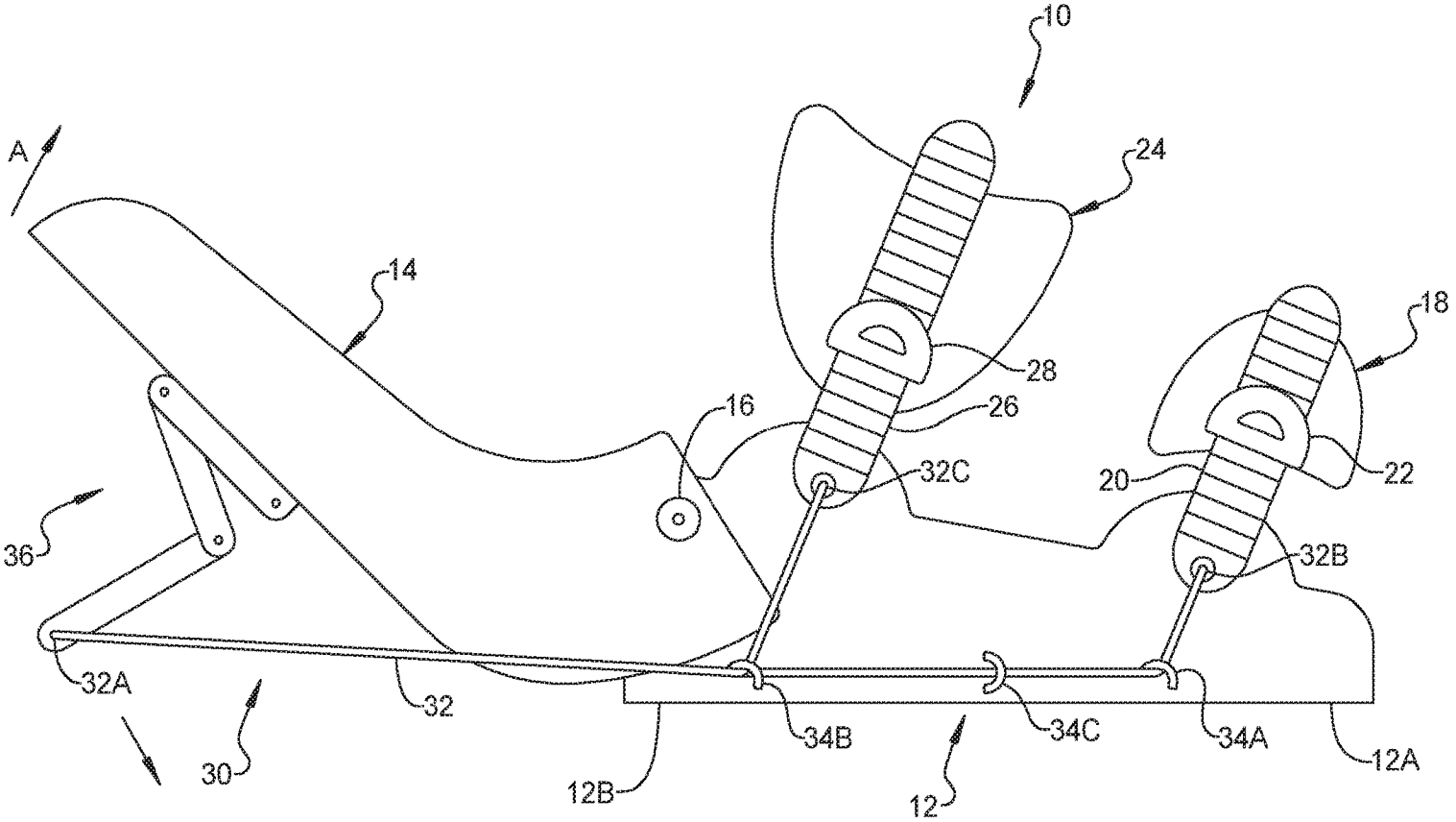
FIG. 1 is a side plan view of a snowboard binding shown in an open position according to the principles of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the Figures. Spatially relative terms may be intended to encompass different orientations of the device in use or operation in addition to the orientation depicted in the Figures. For example, if the device in the Figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

With reference to FIG. 1, the snowboard binding 10 according to the principles of the present disclosure will now be described. The snowboard binding 10 includes a base plate 12 and a heel support 14 pivotally mounted to the base plate at pivot 16. A toe strap 18 is adjustably connected to the base plate 12 by an adjustment strap 20 and an adjustment clamp 22. An ankle strap 24 is adjustably connected to the base plate 12 by an adjustment strap 26 and an adjustment clamp 28. The adjustment clamps 22, 28 can include a ratcheting device that engages teeth on the adjustment straps 20, 26, as is known in the art.

A tensioning device 30 is connected to the heel support 14 and to at least one of the toe strap 18 and the ankle strap 24. It should be understood that the toe strap 18 and the ankle strap 24 could be combined into an integral one-piece strap that may resemble a saddle. According to one aspect of the present disclosure as shown in FIGS. 1-4, the tensioning device 30 can include a cable 32 that is directed through a guide system secured to the base plate 12 and is operably connected to the heel support 14 and to at least one, and preferably both, of the toe strap 18 and the ankle strap 24. The guide system can include one or more cable guide members 34A, 34B that can be mounted or integrally formed at the toe and heel ends 12A, 12B, respectively of the base plate 12. Additional intermediate cable guide members 34C can also be used to guide the cable 32. The cable 32 includes a first end 32A that is connected to a tightening mechanism 36 mounted to the heel support 14. The tightening mechanism 36 can be in the form of a clamp, toggle mechanism or other device. The cable 32 can include one or more attachment ends 32B, 32C that can attach to the adjustment straps 20 and 26 of the toe strap 18 and the ankle strap 24, respectively.

Figure 2:
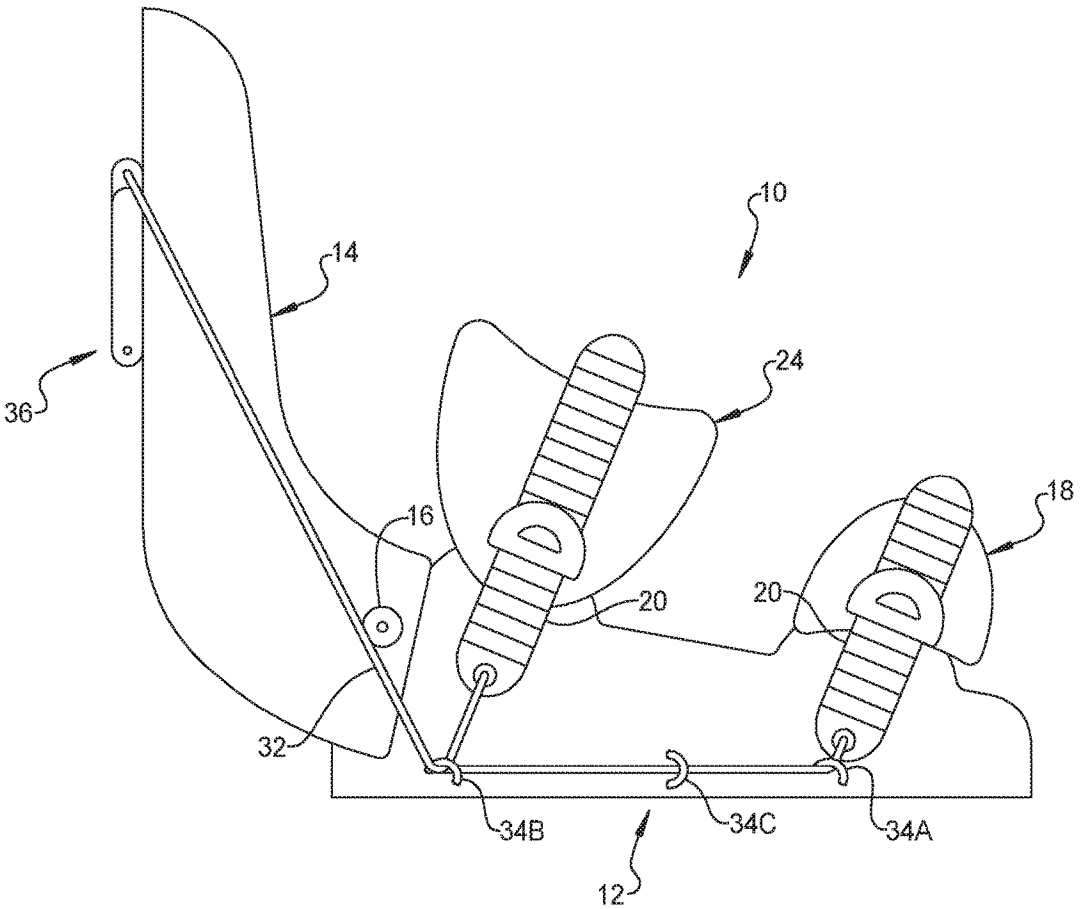
FIG. 2 is a side plan view of the snowboard binding of FIG. 1 shown in a locked position.

In use, the snowboard binding 10 is opened, as shown in FIG. 1 and the user inserts their boot 50 (shown in FIG. 4) into the binding 10 so that the toe of the boot 50 is received under the loosened toe strap 18, the main part of the boot is received under the loosened ankle strap 24 and the heel of the boot is received forward of the rearwardly pivoted heel support 14. Once the boot 50 is inserted, the heel support 14 is pivoted forward in the direction of arrow "A", to the position as illustrated in FIG. 2. As the heel support 14 is pivoted forward, the tensioning mechanism 30 is caused to apply tensioning force on the adjustment straps 20 and 26 of the toe strap and ankle strap 24 thereby automatically pulling them tighter across the user's boot 50. The tightening mechanism 36 (preferably a toggle clamp) heat support can then be moved to a locked position further adding tension to the tensioning mechanism 30 and locking the heel support 14 in the upright position.

During a first use of the snowboard binding 10 the adjustment latches 22 and 28 may be adjusted to adjust a length of the adjustment straps 20 and 26 to provide a secure fit on the boot 50 according to the user's preferences. Subsequently, when the tightening mechanism 36 is released and the heel support 14 is pivoted rearward, the tension on the tensioning mechanism 30 is released and the toe strap 18 and the ankle strap 24 are loosened. Therefore, the user is then able to easily remove their boot 50 from the snowboard binding 10. For subsequent uses of the snowboard binding 10, the user simply inserts the boot 50 into the binding 10 and pivots the heel support 14 to the upright position and secures the tightening mechanism 36 in its locked position. No further adjustment of the adjustment latches 22, 28 is required for subsequent uses while maintaining the user's comfort and stability preferences.

Figure 11:
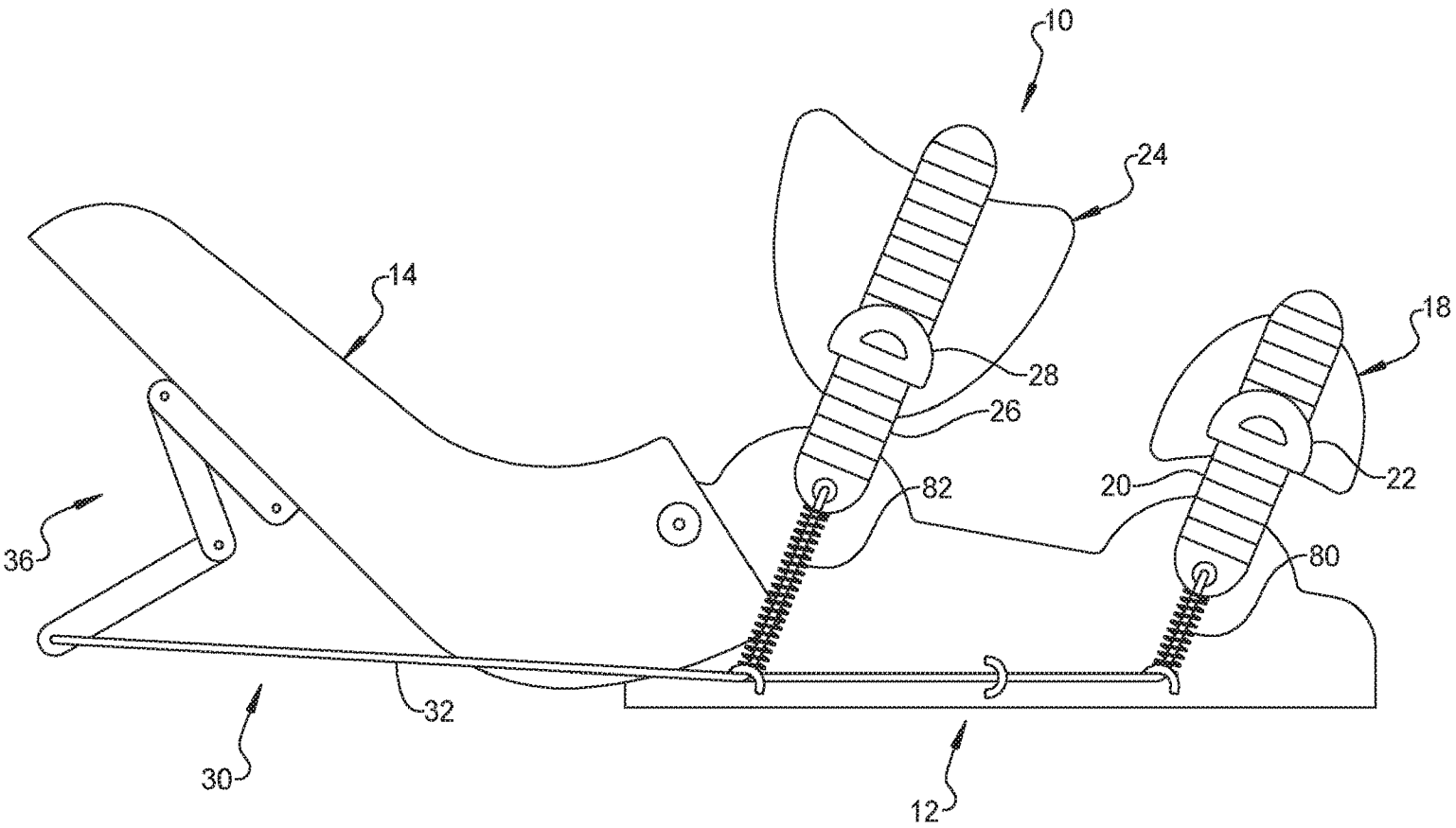
FIG. 11 is a side plan view of a snowboard binding shown in an open position according to the principles of the present disclosure with a spring biased opening feature.
Figure 12:
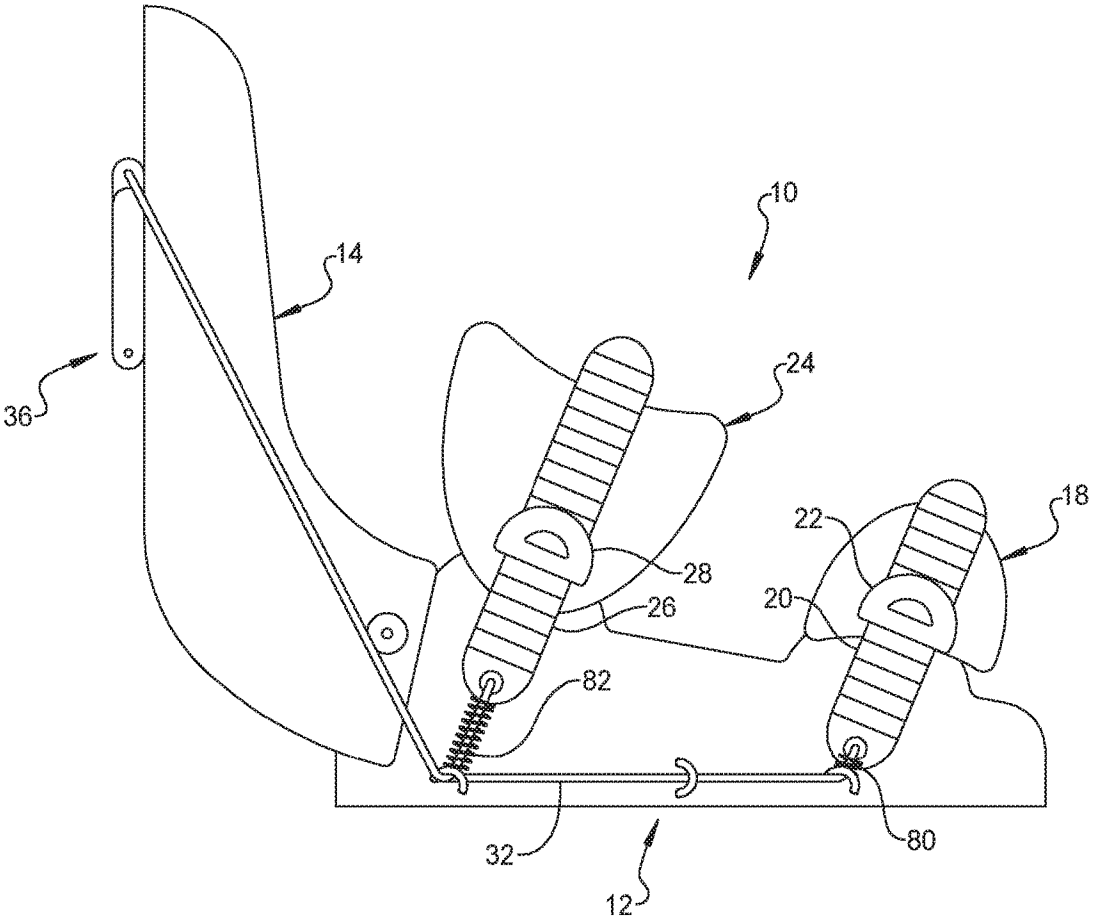
FIG. 12 is a side plan view of the snowboard binding of FIG. 11 shown in a locked position.

The toe strap 18/20 and ankle strap 24/26 can each be provided with a memory material such as spring steel preformed in a desired shape that biases the strap to the upward release position when the tensioning mechanism 30 is released when the heel support is pivoted to the open position shown in FIG. 1. This more readily facilitates the removal of user's boot 50 from the toe and ankle straps 18, 24 by spreading the toe strap 18 and ankle strap 24 away from the boot 50. By way of further example, with reference to FIGS. 11 and 12, the tensioning mechanism 30 can include coil springs 80, 82 disposed on the cables 32 between the toe strap 18 and cable guide 34A and the ankle strap 24 cable guide 34B to bias the toe strap 18 and ankle strap 24 toward their expanded position, as shown in FIG.

11. When the heel support 14 is pivoted to the forward upright position, shown in FIG. 12, the springs 80 and 82 are compressed.

Figure 3:
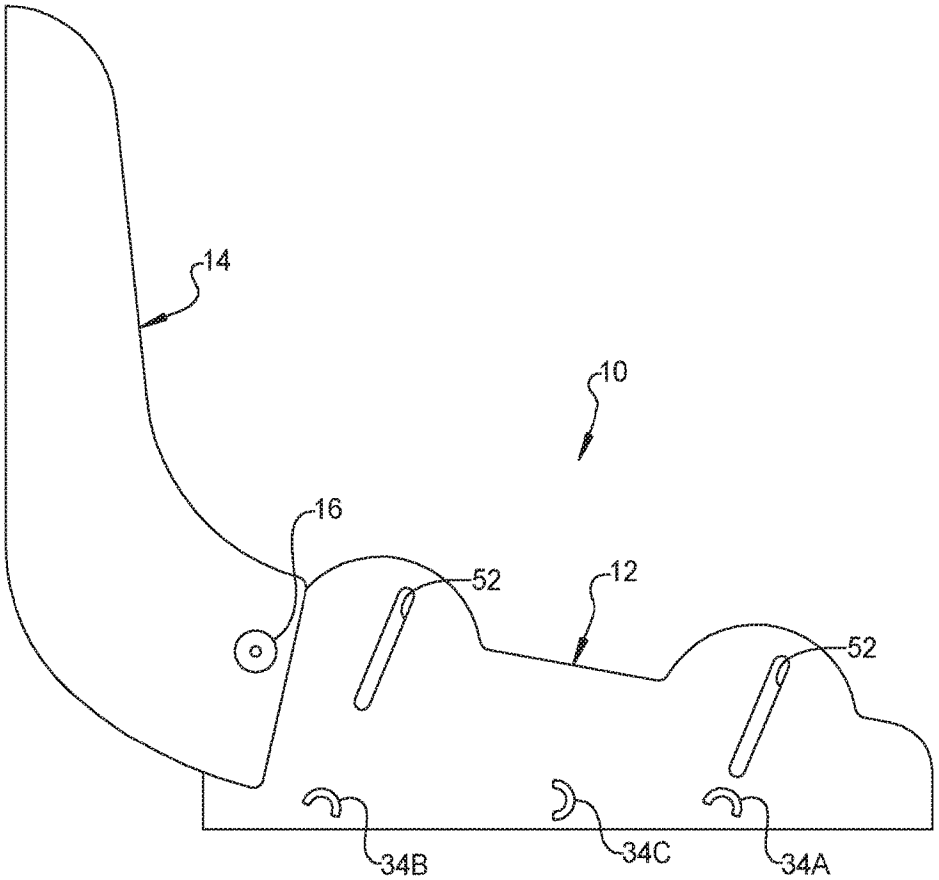
FIG. 3 is a side plan view of the base plate and high back of the snowboard binding shown in FIGS. 1 and 2 with the ankle strap, toe strap and cable removed for illustrative purposes.
Figure 4:
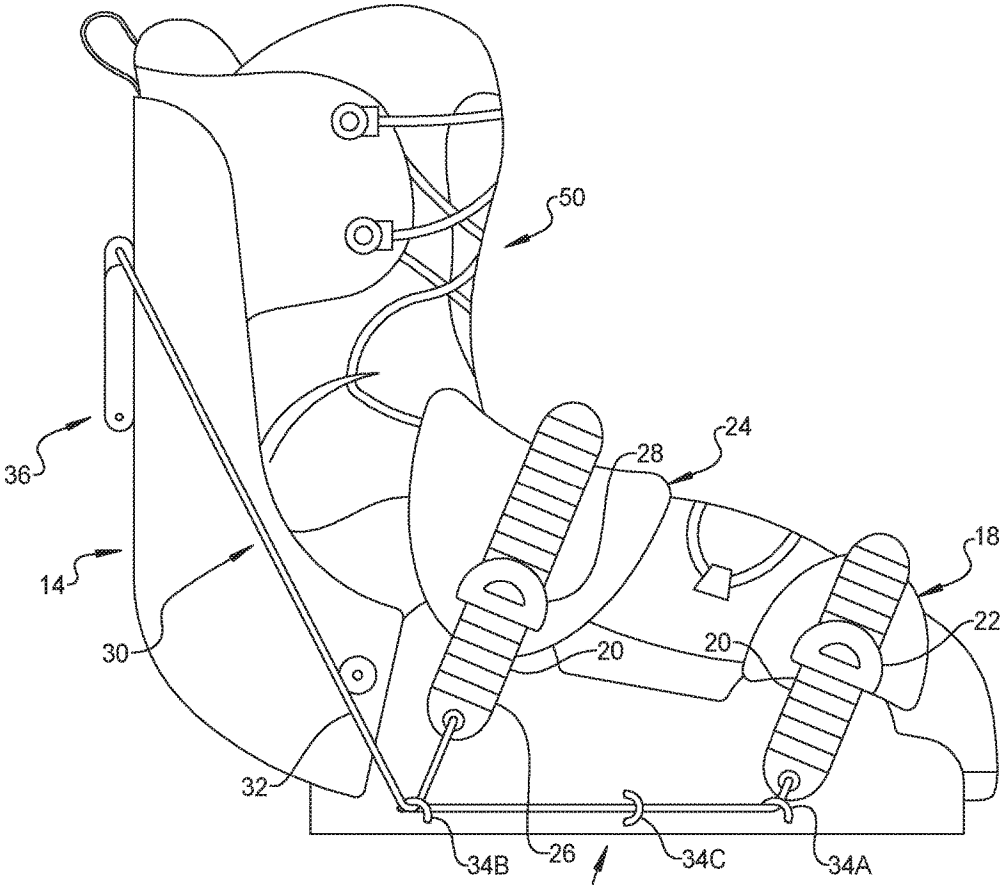
FIG. 4 is a side view of the snowboard binding of FIGS. 1 and 2 illustrating a snowboard boot in a secure position within the binding in a locked position.

FIG. 3 shows the base plate 12 and heel support 14 with other components removed. The base plate 12 can include guide slots 52 that guide the movement of the ends of the toe and ankle adjustment straps 20, 26.

Figure 5:
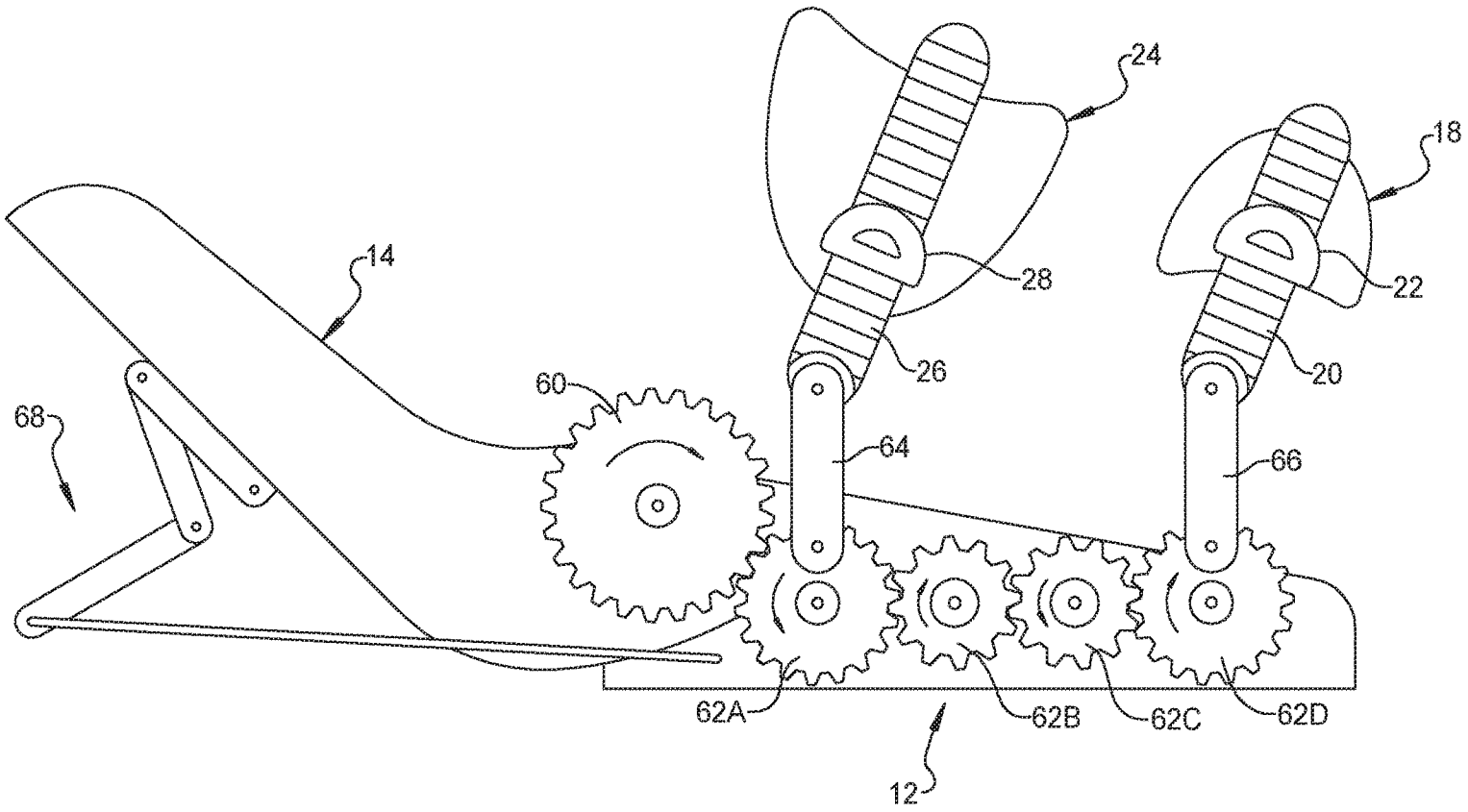
FIG. 5 is a side plan view of a first alternative snowboard binding having gear-type tensioning mechanism shown in an open position.
Figure 6:
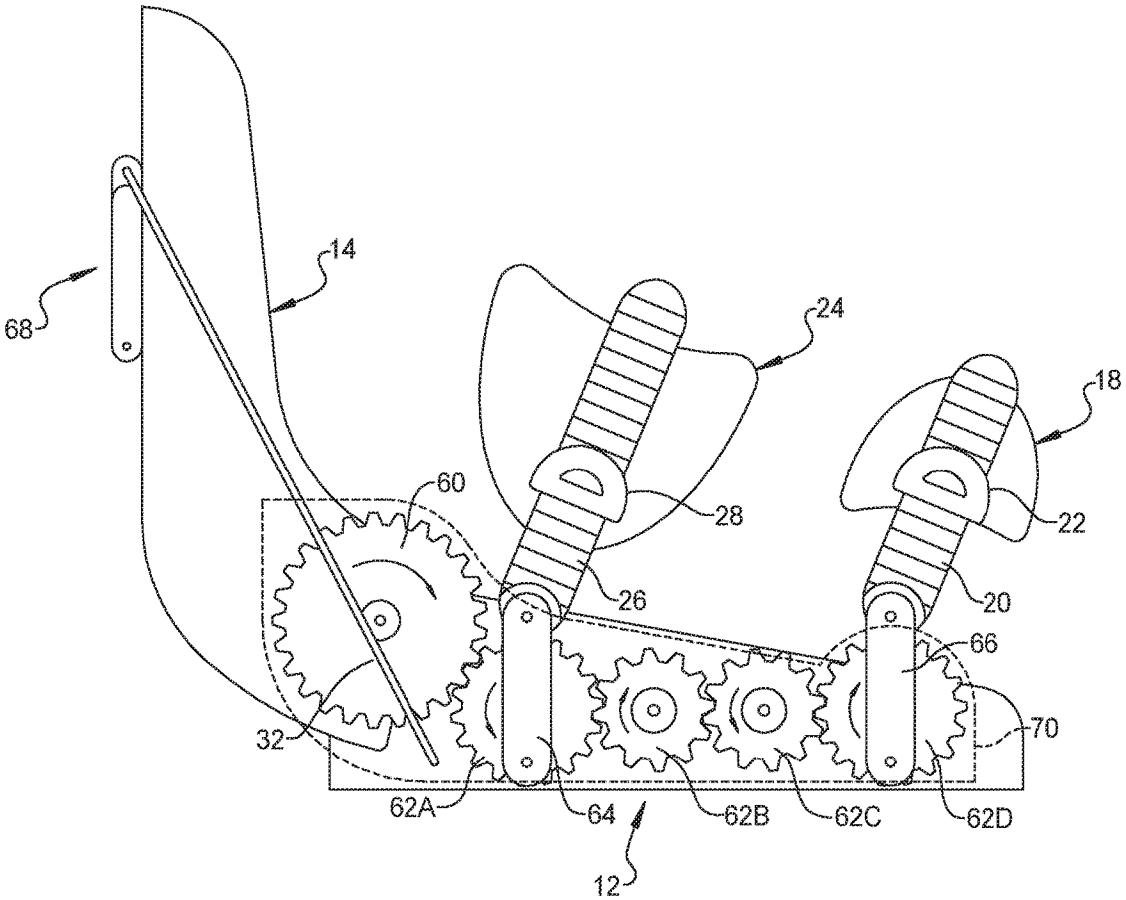
FIG. 6 is a side plan view of the snowboard binding of FIG. 5 having the gear-type tensioning mechanism shown in a closed position.

The tensioning mechanism 30 can take on alternative forms including gears (as shown in FIGS. 5-6), levers (as shown in FIGS. 7-10), gear segments, cams, pulleys and other mechanical devices and combinations thereof. As shown in FIGS. 5-6, a drive gear 60 can be fixedly mounted to the heel support 14 so as to pivot with the heel support 14. The drive gear 60 is engaged with a series of driven gears 62A-62D, each rotatably mounted to the base plate 12 with a first driven gear 62A meshingly engaged with the drive gear 60 and meshingly engaged with a second driven gear 62B. The second driven gear 62B is also meshingly engaged with a third driven gear 62C. The third driven gear 62C is in meshing engagement with a fourth driven gear 62D. In the embodiment shown, the first and fourth driven gears 62A and 62D can each be provided with a tensioning arm 64, 66 attached to the adjustment straps 20 and 26. The tensioning arms 64. 66 are radially offset from a center axis of the driven gears 62A, 62D, respectively, wherein in the open position as illustrated in FIG. 5, the tensioning arms 64, 66 are rotated to an upper vertical position releasing the tension on the adjustment straps 26, 20 so that the user can conveniently insert his/her boot 50 under the ankle and toe straps 24, 18. When the heel support 14 is pivoted to the closed position as illustrated in FIG. 6, the drive gear 60 is pivoted in a clockwise direction, so that the first and fourth driven gears 62A, 62D are rotated in a counterclockwise and a clockwise direction, respectively so that the tensioning arms 64, 66 are moved vertically downward in order to tension the adjustment straps 20, 26. The heel support 14 can be held in the upright closed position by a cable and toggle clamp arrangement 68 that is well known in the art, or by other types of latching mechanisms.

It should be understood that the arrangement, number and sizes of the drive gear 60 and driven gears 62A-62D as well as the position of the tensioning arms 64, 66 can be altered to affect a greater or lesser range of motion (as desired) between the open and closed positions. A cover 70 (shown in FIG. 6) can be used to shield the drive gear 60 and the driven gears 62A-62D. The cover can be transparent to allow the gears to be seen for aesthetic purposes. The lever arms 64, 66 can be guided to remain vertical in the open position to spread the straps 18, 24 to their furthest open position. The advantage of the system of the present disclosure is that the heel support 14 can be moved to its closed position with one motion and the user's boot 50 is consistently secured within the binding without further adjustment being required.

Figure 7:
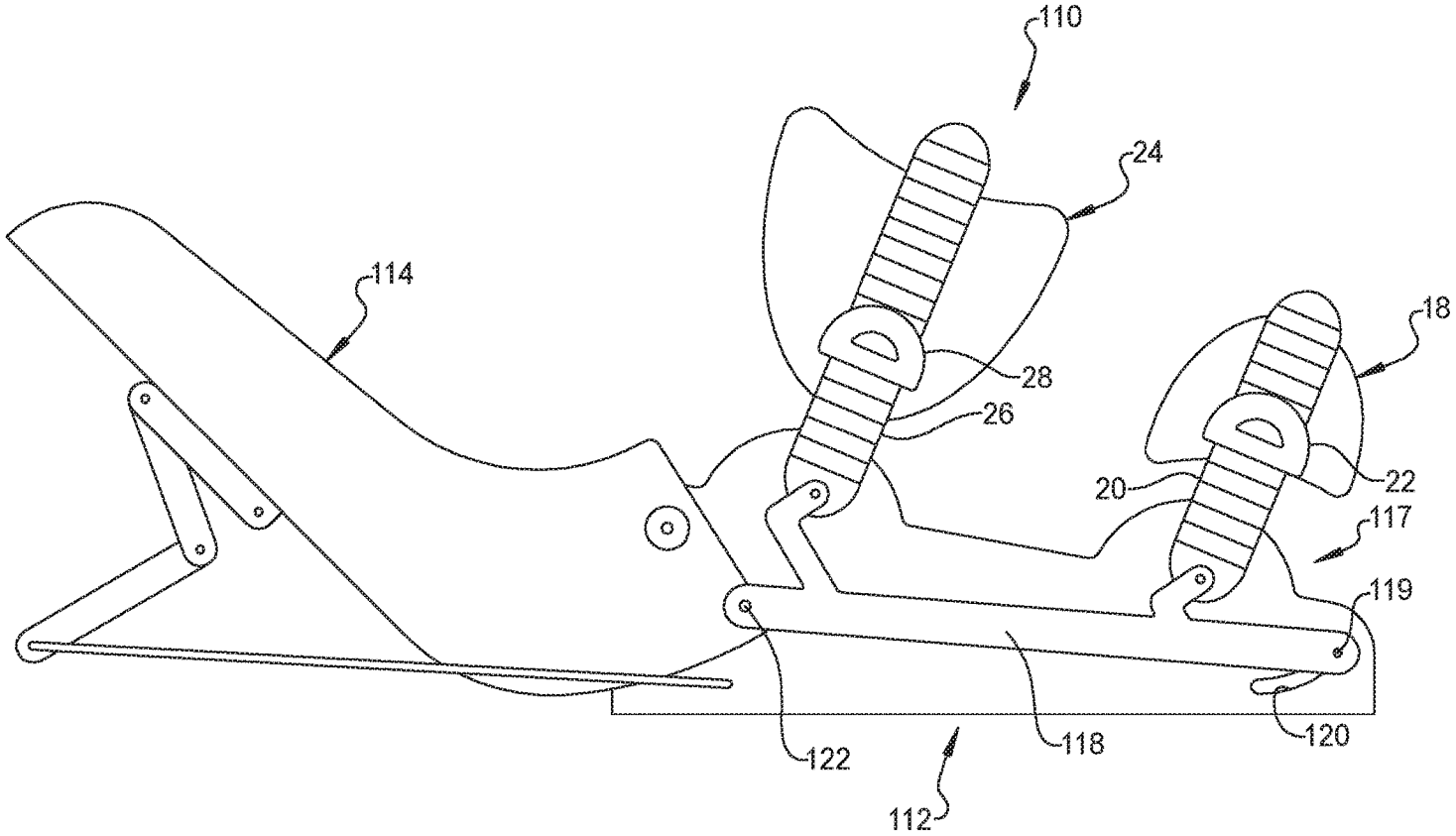
FIG. 7 is a side plan view of a second alternative snowboard binding having a unitary lever-type tensioning mechanism and shown in an open position.
Figure 8:
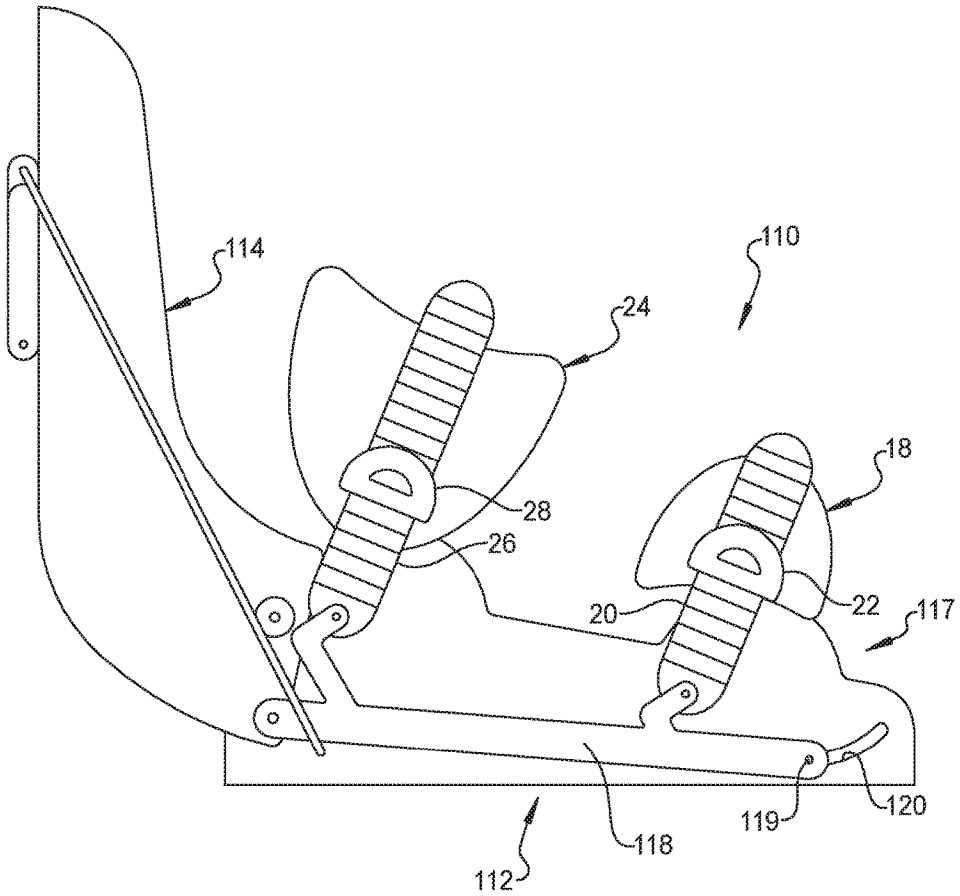
FIG. 8 is a side plan view of the snowboard binding of FIG. 7 having the unitary lever-type tensioning mechanism shown in a closed position.

In an alternative embodiment, as illustrated in FIGS. 7 and 8, a snowboard binding 110 is shown including a base plate 112 and a heel support 114 pivotally connected to the base plate 112 at a pivot point 116. A tensioning mechanism 117 includes a unitary lever arm 118 connected between the base plate 112 and the heel support 114 and is further connected to the adjustment straps 20, 26. The lever arm 118 is provided with a guide pin 119 received in a guide slot 120 at a front end of the base plate 112 and is connected to a pivot pin 122 at a bottom of the heel support 114. In the open position of the heel support 114 as shown in FIG. 7, the forward end of the lever arm 118 is pushed forward and upward in the guide slot 120 and the rearward end of the lever arm 118 is lifted upward by the heel support 114. When the heel support 114 is pivoted upward to the closed position, as shown in FIG. 8, the forward end of the lever arm 118 is pulled rearward and downward along the guide slot 120 and the rearward end of the lever arm 118 moves downward. The downward movement of the lever arm 118 pulls the adjustment straps 20, 26 downward to tighten the toe and ankle straps 18, 24 on a user's boot 50. The amount of the movement of the toe and ankle straps 18, 24 is dependent upon the movement of the lever arm along the guide slot 120 and by the pivoting of the heel support 114. The heel support 14 can be held in the upright closed position by a cable and toggle clamp arrangement 68 that is well known in the art, or by other types of latching mechanisms.

Figure 9:
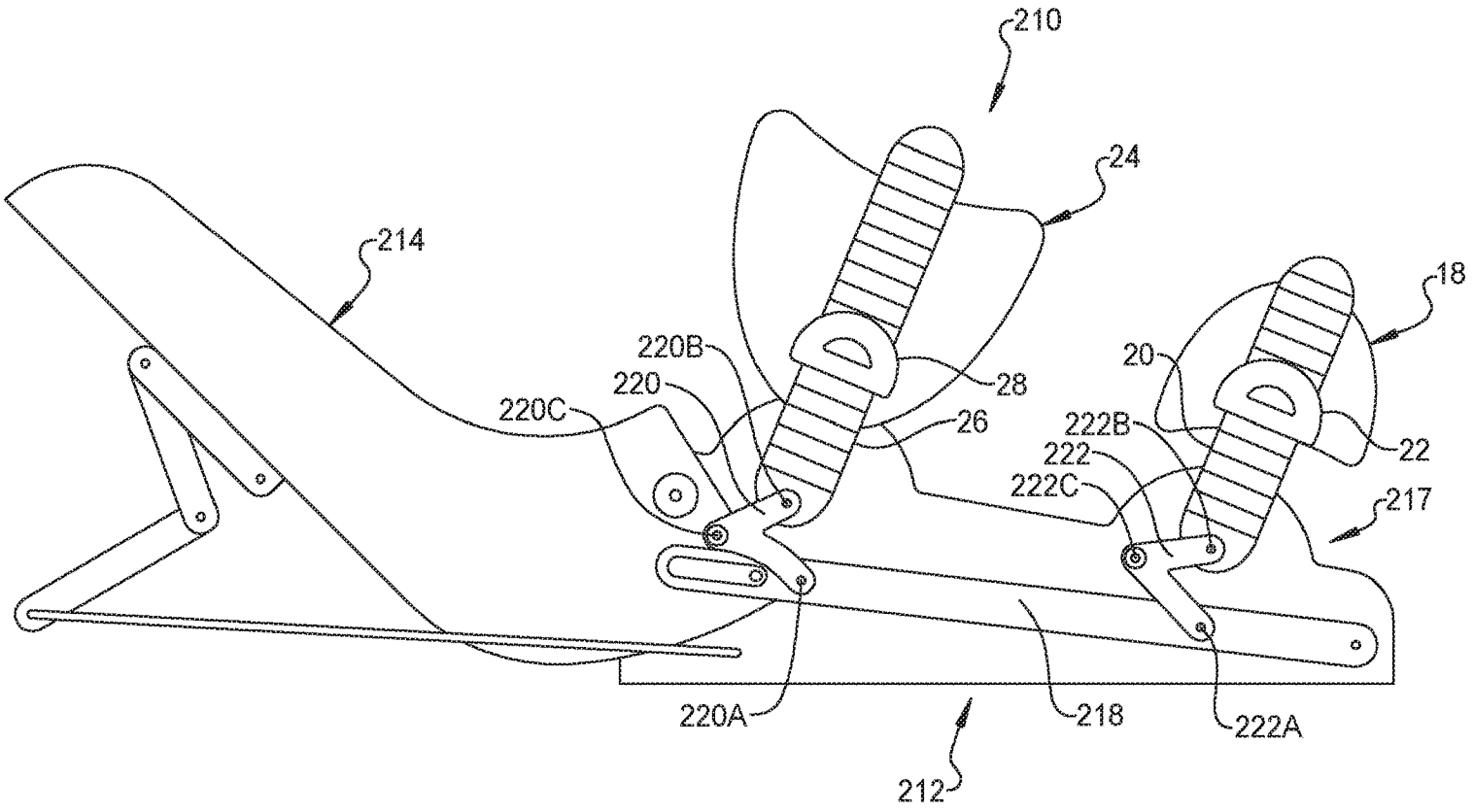
FIG. 9 is a side plan view of a third alternative snowboard binding having a multi-piece lever-type tensioning mechanism and shown in an open position.
Figure 10:
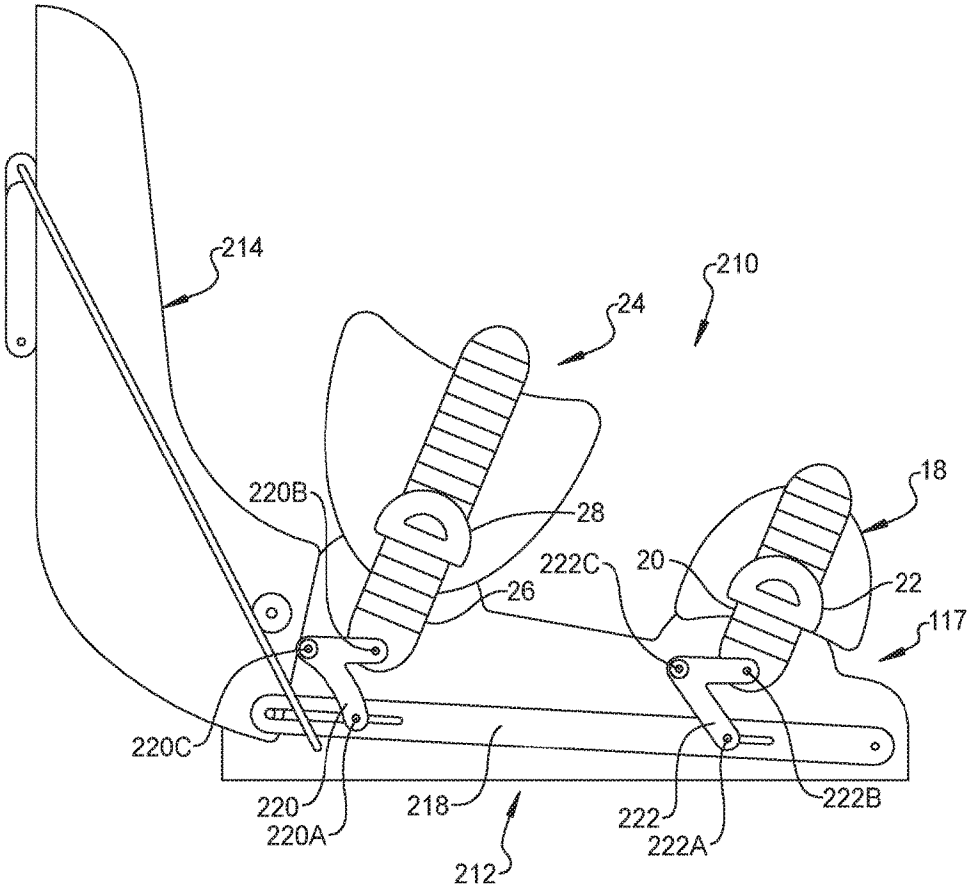
FIG. 10 is a side plan view of the snowboard binding of FIG. 7 having the multi-piece lever-type tensioning mechanism shown in a closed position.

In a further alternative embodiment, as shown in FIGS. 9 and 10, a snowboard binding 210 includes a tensioning mechanism 217 having a series of levers interconnected to the heel support 214. The tensioning mechanism 217 includes a first lever 218 connected to the heel support 214 at a location offset from a pivot point 214A of the heel support 214. The tensioning mechanism 217 includes two additional levers 220, 222 each having a first end 220A, 222A connected to the first lever 218 and each connected to an adjustment strap 20, 26 at a second end 220B, 222B. An intermediate portion 220C, 222C of the levers 220, 222 can be pivotally mounted to the base plate 212. When the heel support 214 is pivoted to the open position, as illustrated in FIG. 9, the first lever 218 presses forward on the first end 220A, 222A of the levers 220, 222 so that the second ends 220B, 222B of the levers 220, 222 are pivoted upward to release the adjustment straps 20, 26 from a user's boot 50. When the heel support 214 is pivoted to the closed position, as shown in FIG. 10, first lever 218 causes the levers 220 and 222 to pivot so that the second ends 220B, 222B pivot downward, thereby tensioning the adjustment straps 20, 26. It should be understood that the arrangement of the levers is for exemplary purposes and other arrangements could also be used.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A binding for a snowboard, comprising:

a base structure;

a heel support pivotally mounted to the base structure for movement between an open position for allowing a user to insert or remove their boot from the binding and a closed position for securing the user's boot in the binding;

an adjustable foot strap attached to the base structure;

a cable attached to the heel support and the adjustable foot strap for applying a tensioning force to the adjustable foot strap when the heel support is moved to the closed position and for releasing the tensioning force from the adjustable foot strap when the heel support is moved to the open position, wherein said cable includes a first end attached to said heel support at a location offset from a pivot axis of the heel support and a second end connected directly to said adjustable foot strap.

2. The binding according to claim 1, wherein an intermediate portion of said cable is engaged with a guide member fixed to said base structure whereby as said heel support is pivoted to the closed position, the cable is pulled along the guide member to apply the tensioning force to the adjustable foot strap.

3. The binding according to claim 1, wherein said adjustable foot strap includes a ratcheting mechanism for adjusting a length of the adjustable foot strap.

4. The binding according to claim 1, further comprising a spiral spring member surrounding the cable for biasing the adjustable foot strap toward an open position.

5. The binding according to claim 1, further comprising a toggle clamp connected to the cable for securing the heel support in the closed position.

6. The binding according to claim 5, wherein the toggle clamp has a first position for securing the heel support in the closed position and a second position for releasing said heel support from the closed position.

* * * * *